US007574872B2

(12) United States Patent
Moon et al.

(10) Patent No.: US 7,574,872 B2
(45) Date of Patent: Aug. 18, 2009

(54) CAPACITY-VARIABLE AIR CONDITIONER

(75) Inventors: Dong Soo Moon, Seoul (KR); Hyun Jong Kim, Seoul (KR); Sim Won Chin, Seoul (KR)

(73) Assignee: LG Electronics Inc., Seoul (KR)

( * ) Notice: Subject to any disclaimer, the term of this patent is extended or adjusted under 35 U.S.C. 154(b) by 469 days.

(21) Appl. No.: 11/332,201

(22) Filed: Jan. 17, 2006

(65) Prior Publication Data

US 2006/0162356 A1 Jul. 27, 2006

(30) Foreign Application Priority Data

Jan. 27, 2005 (KR) ..... 10-2005-0007748

(51) Int. Cl.
*F25B 41/00* (2006.01)
*F25B 49/00* (2006.01)

(52) U.S. Cl. ..... 62/196.3; 62/228.5

(58) Field of Classification Search ..... 62/196.2, 62/196.3, 200, 228.5, 196.1
See application file for complete search history.

(56) References Cited

U.S. PATENT DOCUMENTS 4,709,555 A * 12/1987 Kawai et al. ..... 62/228.3
4,774,816 A * 10/1988 Uchikawa et al. ..... 62/324.1
5,062,274 A * 11/1991 Shaw ..... 62/117
5,074,760 A 12/1991 Hirooka et al.
5,074,761 A 12/1991 Hirooka et al.
6,449,972 B2 * 9/2002 Pham et al. ..... 62/228.3
6,708,510 B2 * 3/2004 Sulc et al. ..... 62/151
6,820,434 B1 * 11/2004 Gutheim et al. ..... 62/175
6,892,548 B2 5/2005 Choi et al.
6,928,828 B1 * 8/2005 Taras et al. ..... 62/175
6,931,867 B2 * 8/2005 Healy et al. ..... 62/157
2001/0022079 A1 * 9/2001 Blot-carretero et al. .. 60/39.281
2003/0037553 A1 * 2/2003 Sulc et al. ..... 62/151
2004/0129017 A1 7/2004 Choi et al.
2005/0019178 A1 * 1/2005 Shin et al. ..... 417/410.5
2005/0044877 A1 3/2005 Chin et al.

FOREIGN PATENT DOCUMENTS

CN 1517557 8/2004
EP 0354867 2/1990
JP 58-65997 4/1983

OTHER PUBLICATIONS

English language Abstract of JP 58-65997.
English language Abstract of CN 1517557, Aug, 4, 2004.

* cited by examiner

*Primary Examiner*—Marc E Norman
(74) *Attorney, Agent, or Firm*—Birch, Stewart, Kolasch & Birch, LLP

(57) ABSTRACT

A capacity-variable air conditioner is capable of controlling capacity and consumed electricity in response to operation mode. The refrigerant compression quantity of a compressor is variably adjusted by control of open/close operation modes via selective combination of open/close valves of bypass pipes and bypass valve of the compressor in response to the operation mode. The capacity-variable air conditioner discharges some of the refrigerant infused into the compressor while the bypass valve of the compressor is opened under energy saving operation mode, such that refrigerant circulation quantity can be adjustably reduced under the energy saving operation mode where load of the compressor is less than that of a normal operation mode, thereby enabling a reduction in the capacity and consumed electricity.

8 Claims, 8 Drawing Sheets

CAPACITY-VARIABLE AIR CONDITIONER

This application claims the benefit of the Korean Application No. 10-2005-0007748 filed on Jan. 27, 2005, which is hereby incorporated by reference.

BACKGROUND OF THE INVENTION

1. Field of the Invention

The present invention relates to an air conditioner. More particularly, the present invention relates to a capacity-variable air conditioner configured to adjust refrigerant compression quantity of a compressor via bypass type refrigerant liquid quantity control thereby enabling to operate under an energy-efficient mode.

2. Description of the Related Art

Use of air conditioners like cooling and heating apparatus has been gradually expanded due to increased desire to pursue a pleasant environment in living spaces as well as office spaces. The air conditioner, as is well known, embodies a cooling or a heating function by a driving operation of a cooling cycle where a heat exchanging medium is circulated between an indoor unit and an outdoor unit.

The indoor unit acts to suck and discharge room air by way of mutual operation of a heat exchanger (evaporator) and a blow fan. The outdoor unit disposed with a compressor, a condenser and a cooling fan functions to suck and discharge outdoor air.

The indoor unit serves to evaporate via a heat exchanger refrigerant of high temperature and high pressure introduced through a compressor and a condenser mounted at an outdoor unit and phase-change the refrigerant to gaseous state. Under the circumstance, the refrigerant deprives air of heat via heat exchange to generate cold air, which is supplied to a room space and used to carry out cooling and freezing in response to operation of the blowing fan.

The cooling system of the conventional air conditioner thus described, well known in the art, and illustrated in FIG. 1 includes a compressor (1), a condenser (12), an expansion device (13) and an evaporator (14).

The compressor (11) compresses gaseous refrigerant to a gas refrigerant of high temperature and high pressure, while the condenser (12) causes the gas refrigerant of high temperature and high pressure to discharge heat and phase-changes the refrigerant to that of liquid state. The liquefied refrigerant of high pressure and high temperature is reduced in pressure while passing through the expansion device (13) to be evaporated in the evaporator (14). Under the circumstance, the refrigerant absorbs the ambient heat in the course of evaporation to cool the ambient air of the evaporator (14), which in turn forms a cool air and this is supplied indoors. The evaporated refrigerant is again infused into the compressor (11) to be compressed to a gas of high temperature and high pressure.

In other words, the conventional air conditioner is operated in such a manner that gaseous refrigerant of high temperature and high pressure discharged from the compressor (11) is cooled by the condenser (12) by way of blowing operation of a condenser fan (15) to form a liquefied refrigerant. The liquefied refrigerant thus formed passes through the expansion device (13) to be changed to two-phase refrigerant of low pressure and low temperature and sent to the evaporator (14). The two-phased refrigerant in the evaporator (14) is heated by an evaporator fan (16) and changed to gaseous refrigerant. The gaseous refrigerant is infused into the compressor (11) and repeats the process of being compressed to gas of high temperature and high pressure. In other words, the air conditioner is operated by the cooling cycle.

However, there is a disadvantage in the conventional air conditioner thus described in that excessive consumption of energy caused by intermittent operation of the compressor (11) under a normal drive mode deteriorates the pleasantness of operation and brings forth a problem of energy conservation.

SUMMARY OF THE INVENTION

Accordingly, the present invention is directed to substantially obviate one or more of the problems due to limitations and disadvantages of the related art. It is therefore an object of the present invention to provide a capacity-variable air conditioner configured to control capacity and energy consumption by operation control of open/close valve of bypass pipe adjustable of refrigerant compression quantity of a compressor according to operation mode.

To achieve these objects and other advantages and in accordance with the purpose of the present invention, as embodied and broadly described herein, the capacity-variable air conditioner comprises: a compressor disposed with a bypass pipe connector mounted therein with a refrigerant inlet, a refrigerant outlet and a bypass valve; a condenser for condensing refrigerant infused by being discharged from the compressor; an expansion device for reducing pressure of the refrigerant condensed by the condenser to a evaporable state; an evaporator for evaporating the refrigerant expanded by the expansion device by heat-exchanging with ambient air; a refrigerant circulation pipe connected to the refrigerant inlet and the refrigerant outlet for forming a refrigerant circulation route by being connected to the condenser, the expansion device and the evaporator; bypass pipes so mounted as to connect the bypass pipe connector of the compressor to the refrigerant circulation pipe; and at least one or more open/close valves for selectively opening and closing the bypass pipe so that refrigerant compression quantity of the compressor can be adjusted in response to operation mode.

The bypass valves are so controlled as to be opened and closed by changes of refrigerant pressure relative to the openness and closeness of the bypass pipe, where the bypass valves are so controlled as to be closed during a normal mode operation, and opened during an energy-saving mode operation.

According to one aspect of the present invention, the bypass pipe comprises: a first bypass pipe connected at both respective ends thereof to a refrigerant circulation pipe at the refrigerant inlet side of the compressor and to the bypass pipe connector of the compressor; and a second bypass pipe for connecting the refrigerant circulation pipe of the refrigerant outlet side of the compressor to the first bypass pipe.

The first bypass pipe and the second bypass pipe may be respectively disposed with a first open/close valve and a second open/close valve. The first open/close valve and the second open/close valve are so controlled as to conduct mutually opposed open/close operations in response to operation mode.

The refrigerant compression quantity of the compressor is controllably adjusted by the openness of the bypass valve in response to changes of the refrigerant pressure that occur by a control where the first open/close valve is opened and concurrently the second open/close valve is closed during the energy-saving mode operation.

In accordance with another aspect of the present invention, a connector of the first bypass pipe and the second bypass pipe is mounted with an open/close valve. The open/close valve may be either a 3-way valve or a 4-way valve.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE INVENTION

Figure 1:
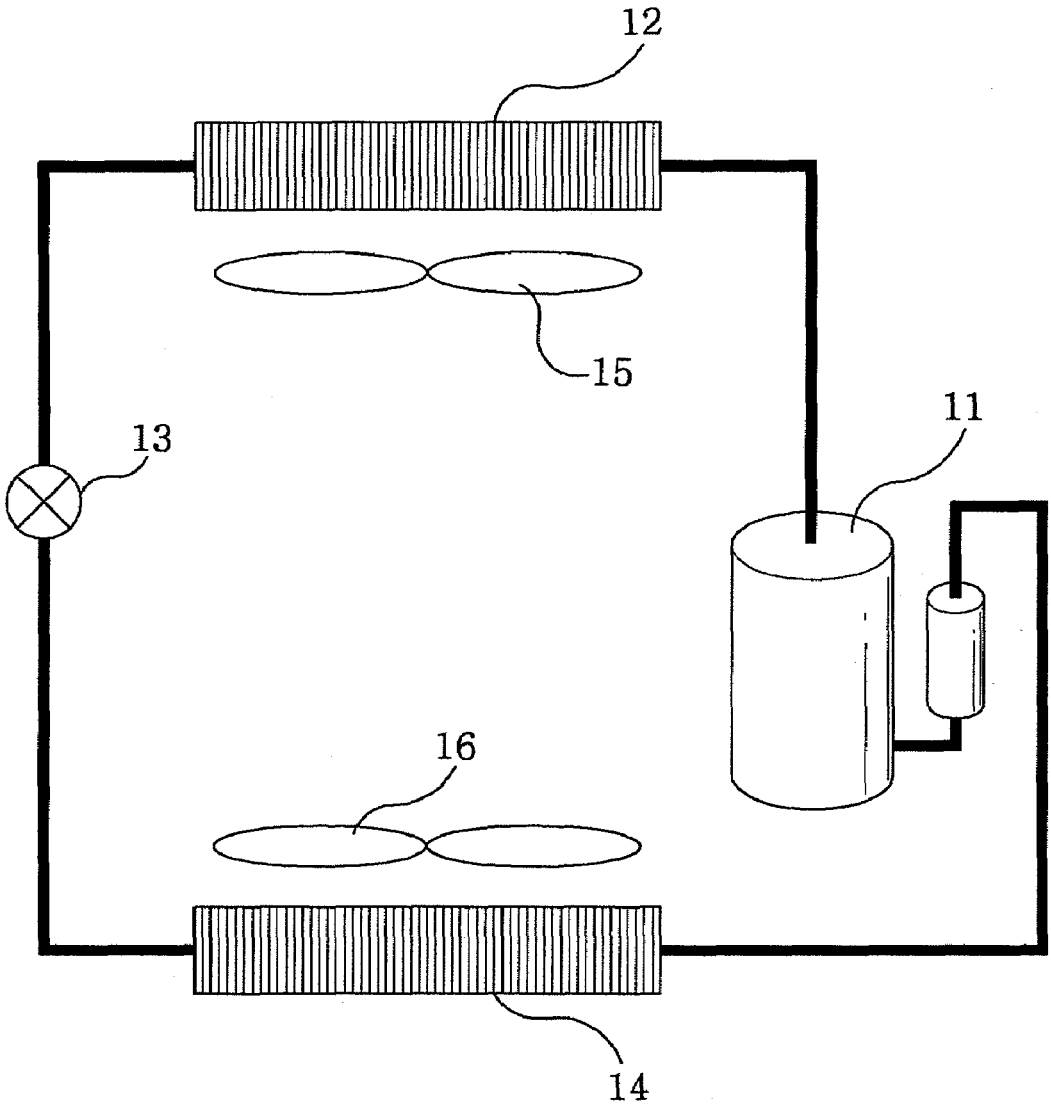
FIG. 1 PRIOR ART
FIG. 1 is a schematic structural diagram illustrating a cooling system of a conventional air conditioner.
Figure 2:
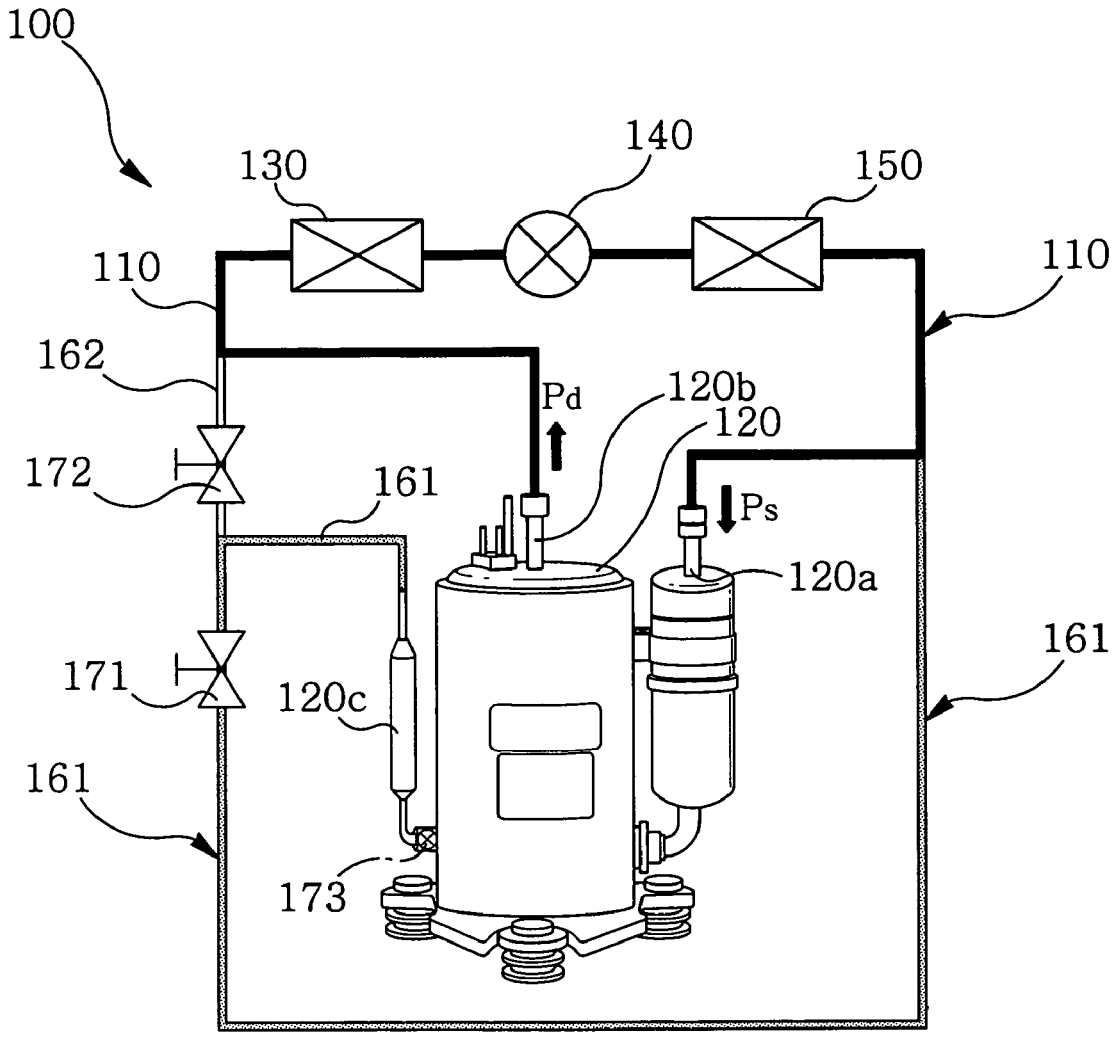
FIG. 2 is a schematic diagram illustrating a capacity-variable air conditioner according to a first embodiment of the present invention.

Referring to FIG. 2, a capacity-variable air conditioner (100) according to the first embodiment of the present invention includes a compressor (120) so disposed as to be connected by a refrigerant circulation pipe (110) forming a refrigerant circulation passage, a condenser (130), an expansion device (140), an evaporator (150), bypass pipes (161. 162) and at least one or more open/close valves (171.172.173) for opening and closing the bypass pipes (161.162).

The compressor (120) includes a bypass pipe connector (120*c*) mounted therein with a refrigerant inlet (120*a*), a refrigerant outlet (120*b*) and a bypass valve (173). The condenser (130) serves to condense the refrigerant discharged from the compressor (120). The expansion device (140) acts to reduce pressure of the refrigerant condensed by the condenser (130) to an evaporable state. The evaporator (150) functions to evaporate the refrigerant expanded by the expansion device by heat-exchanging with ambient air.

The refrigerant circulation pipe (110) is connected at both ends thereof to a refrigerant inlet (120*a*) and a refrigerant outlet (120*b*) of the compressor (120), and the condenser (130), the expansion device (140) and the evaporator (150) are connected to the refrigerant circulation pipe (110) so as to be sequentially arranged on the closed refrigerant circulation route formed between the refrigerant inlet (120*a*) and the refrigerant outlet (120*b*).

The bypass pipe comprises a first bypass pipe (161) and a second bypass pipe (162), where the first bypass pipe (161) is connected at distal ends thereof to a refrigerant circulation pipe (110) of the refrigerant inlet (120*a*) side and to a bypass pipe connector (120*c*) of the compressor (120). The second bypass pipe (162) is so disposed as to connect the refrigerant circulation pipe (110) of the refrigerant outlet (120*b*) side of the compressor (120) to the first bypass pipe (161).

The first bypass pipe (161) and the second bypass pipe (162) are mounted therein with a first open/close valve (171) and a second open/close valve (172). The first open/close valve (171) and the second open/close valve (172) are respectively controlled in opening and closing thereof in response to each operation mode, and the first and second bypass pipes (161. 162) are forced to be selectively opened and closed such that the refrigerant compression quantity of the compressor (120) is adjusted.

According to the first embodiment of the present invention, the first and second open/close valves (171.172) are so controlled as to be oppositely opened and closed according to the operation mode. The bypass valve (173) is so controlled as to be opened and closed by a changed state of the refrigerant pressure in response to the open/close states of the bypass pipes (161.162). The bypass valve (173) according to the present invention is closed under a normal operation mode and opened under an energy saving operation mode.

According to the capacity-variable air conditioner according to the present invention, the bypass valve (173) is opened by the changed state of the refrigerant pressure that are generated by the control where the first open/close valve (171) is opened under the normal operation mode and the second open/close valve (172) is concurrently closed, such that the refrigerant compression quantity of the compressor (120) is variably adjusted.

Now, operational state of the capacity-variable air conditioner in response to the operation mode will be described in detail with reference to FIGS. 3*a*, 3*b*, 4*a* and 4*b* according to one embodiment of the present invention.

Figure 3A:
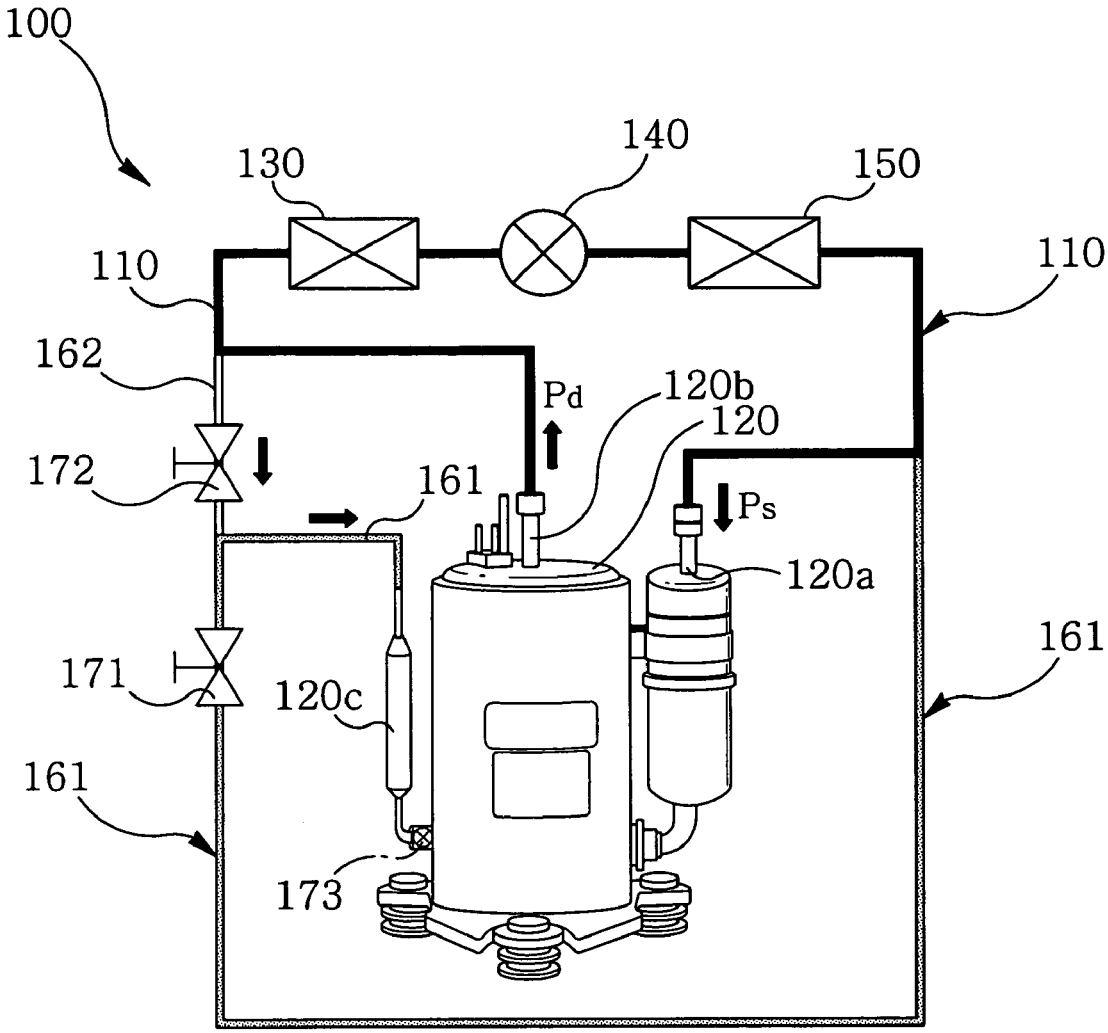
FIGS. 3*a* and 3*b* are schematic diagrams explaining an operational state of a compressor and refrigerant flow state during a normal mode operation of a capacity-variable air conditioner according to the present invention.

Referring to FIG. 3*a*, the first open/close valve (171) of the first bypass pipe (161) is closed and at the same time the second open/close valve (172) of the second bypass pipe (162) is opened by a control signal of a microcomputer (not shown) when the capacity-variable air conditioner according to the present invention selects a normal operation mode.

Under the circumstance, the refrigerant of high pressure discharged from the refrigerant outlet (120*b*) of the compressor (120) applies pressure to the bypass valve (173) disposed at the bypass pipe connector (120*c*) of the compressor (120) and keeps the closed state of the bypass valve (173).

Figure 3B:
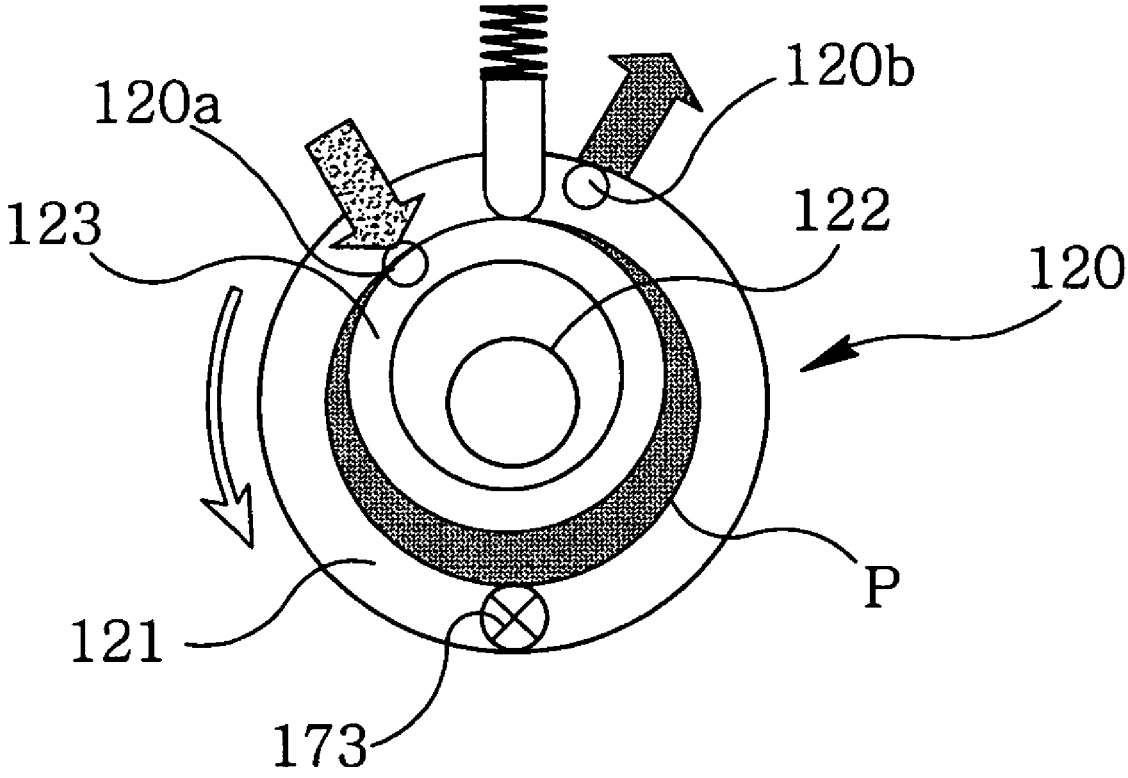

As illustrated in FIG. 3*b*, because the compressor (120) maintains the closeness of the bypass valve (173), the refrigerant quantity infused via the refrigerant inlet (120*a*) of the compressor (120) is compressed and kept in a compression region (P) as in the normal operation mode of the conventional air conditioner, where unexplained reference numeral 121 in FIG. 3*b* is a compressor housing, 122 is a rotor shaft, and 123 is an eccentric unit.

In other words, in the capacity-variable air conditioner according to the present invention, the gaseous refrigerant of high temperature and high pressure compressed by the compressor (120) with the bypass valve (173) being shut off during the normal operation mode is condensed to liquefied state by the condenser (130), is reduced in pressure while passing through the expansion device (140), absorbs the ambient heat by way of evaporating action of the evaporator (150), and discharges the cooling air thus generated to the inside of a room space.

Figure 4A:
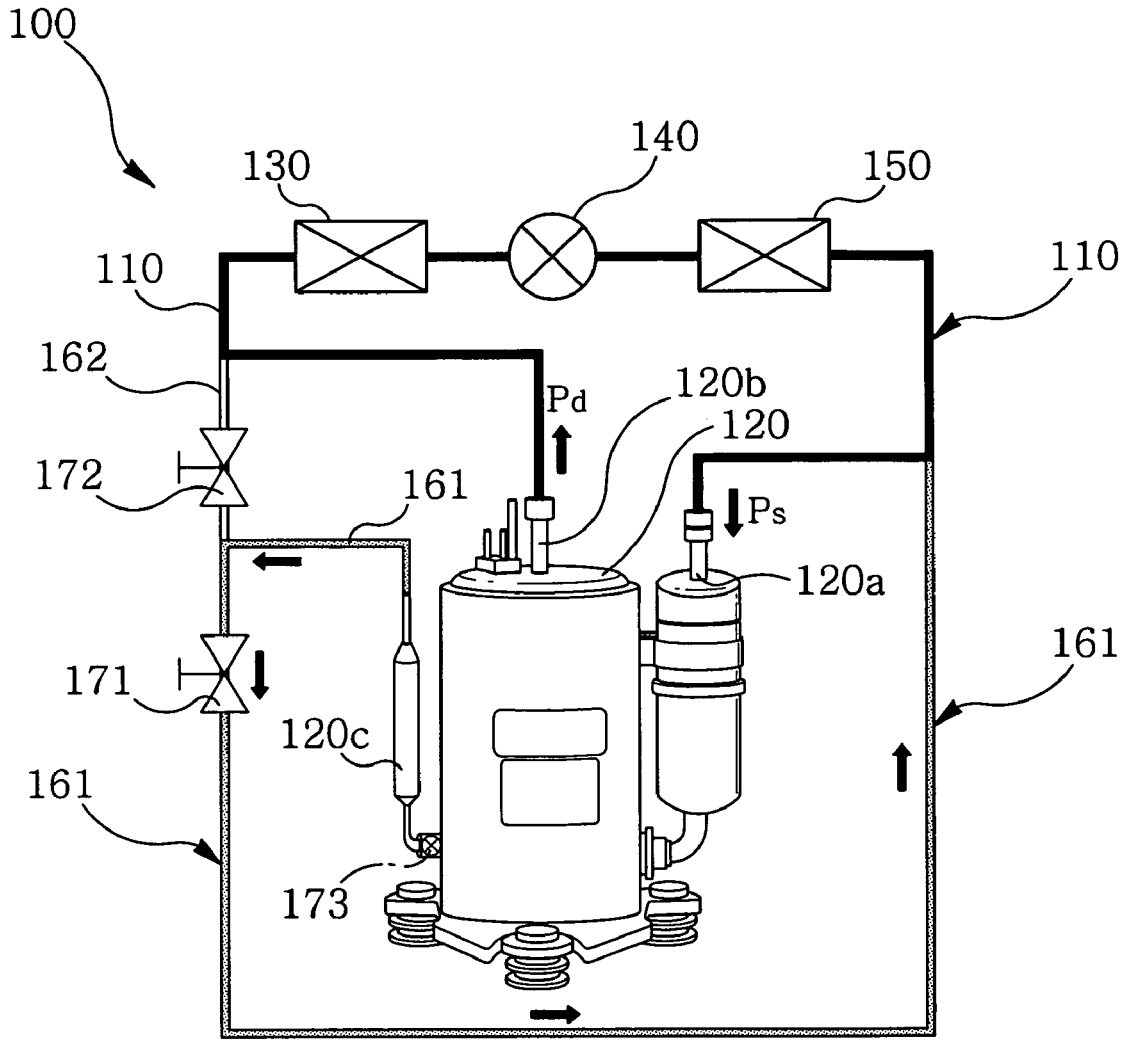
FIGS. 4*a* and 4*b* are schematic diagrams explaining an operational state of a compressor and refrigerant flow state during an energy-saving mode operation of a capacity-variable air conditioner according to the present invention.

Referring to FIG. 4*a*, the first open/close valve (171) of the first bypass pipe (161) is opened by a control signal of a microcomputer (not shown) when the capacity-variable air conditioner selects an energy saving operation mode, and the second open/close valve (172) of the second bypass pipe (162) is simultaneously closed.

Figure 4B:
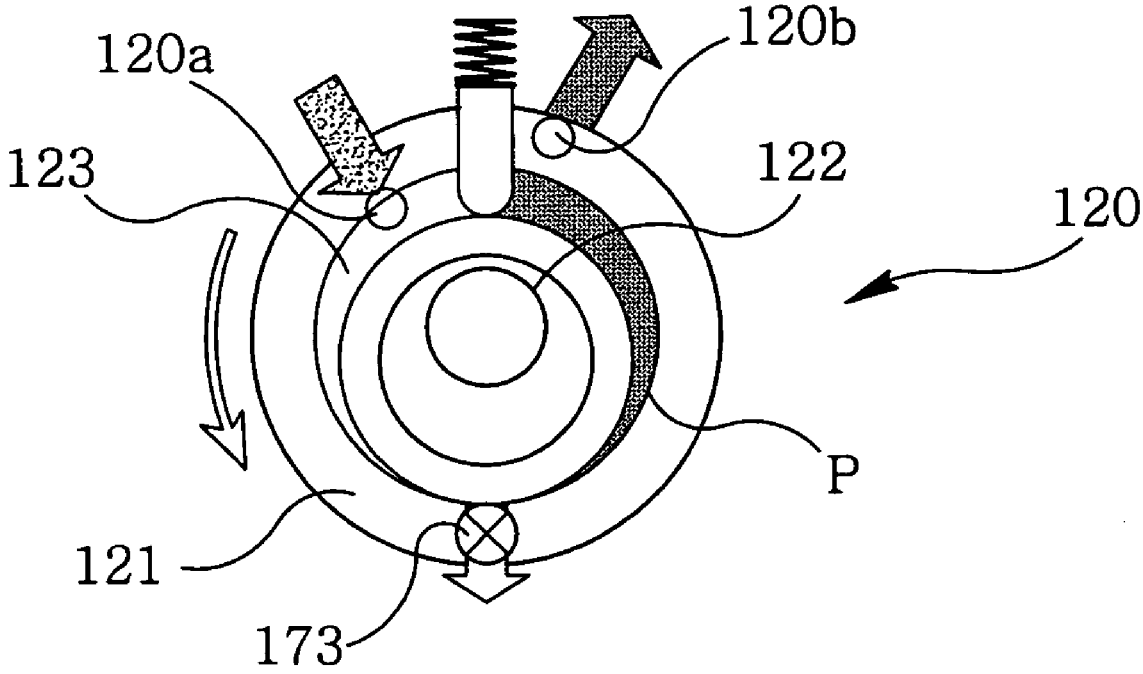

Consequently, the first bypass pipe (161) maintains a lower pressure state relative to that of an inside of the compressor (120), such that the bypass valve (173) disposed at the bypass pipe connector (120*c*) of the compressor (120) keeps an opened state. Under the circumstance, the compressor (120) is operated in such a manner that because the bypass valve (173) maintains the opened state, as shown in FIG. 4*b*, some of the refrigerant compressively infused through the refrigerant inlet (120*a*) of the compressor (120) is discharged to the first bypass pipe (161) via the bypass valve (173) and is infused again to the refrigerant inlet (120*a*).

Under the circumstance, the pressure-reduced refrigerant that is infused into the compressor (120) is further reduced in pressure in the compression region (P) and discharged to condenser (130). Unexplained reference numeral 121 in FIG. 4*b* is a compressor housing, 122 is a rotor shaft, and 123 is an eccentric unit.

In other words, the capacity-variable air conditioner according to the present invention is operated in such a manner that part of the refrigerant infused into the compressor (120) is discharged while the bypass valve (173) is opened during the energy saving operation mode so that refrigerant, the quantity of which is less than that of the normal operation mode, is compressed and circulated.

Accordingly, the capacity-variable air conditioner according to the present invention is operated in such a manner that the circulated quantity of refrigerant is reduced during the energy saving mode where the compressor is less-loaded relative to the normal operation mode to thereby enable to reduce the capacity and the energy consumption.

To put in a nutshell, according to the embodiments of the present invention, the quantity of the refrigerant of the compressor (120) can be variably adjusted according to the operation mode via control of opening and closing operations in response to selective combination of the bypass valve (173) of the compressor (120) and open/close valves (171.172) of the bypass pipes (161.162), thereby enabling to control the capacity of the air conditioner and electricity consumption.

Figure 5A:
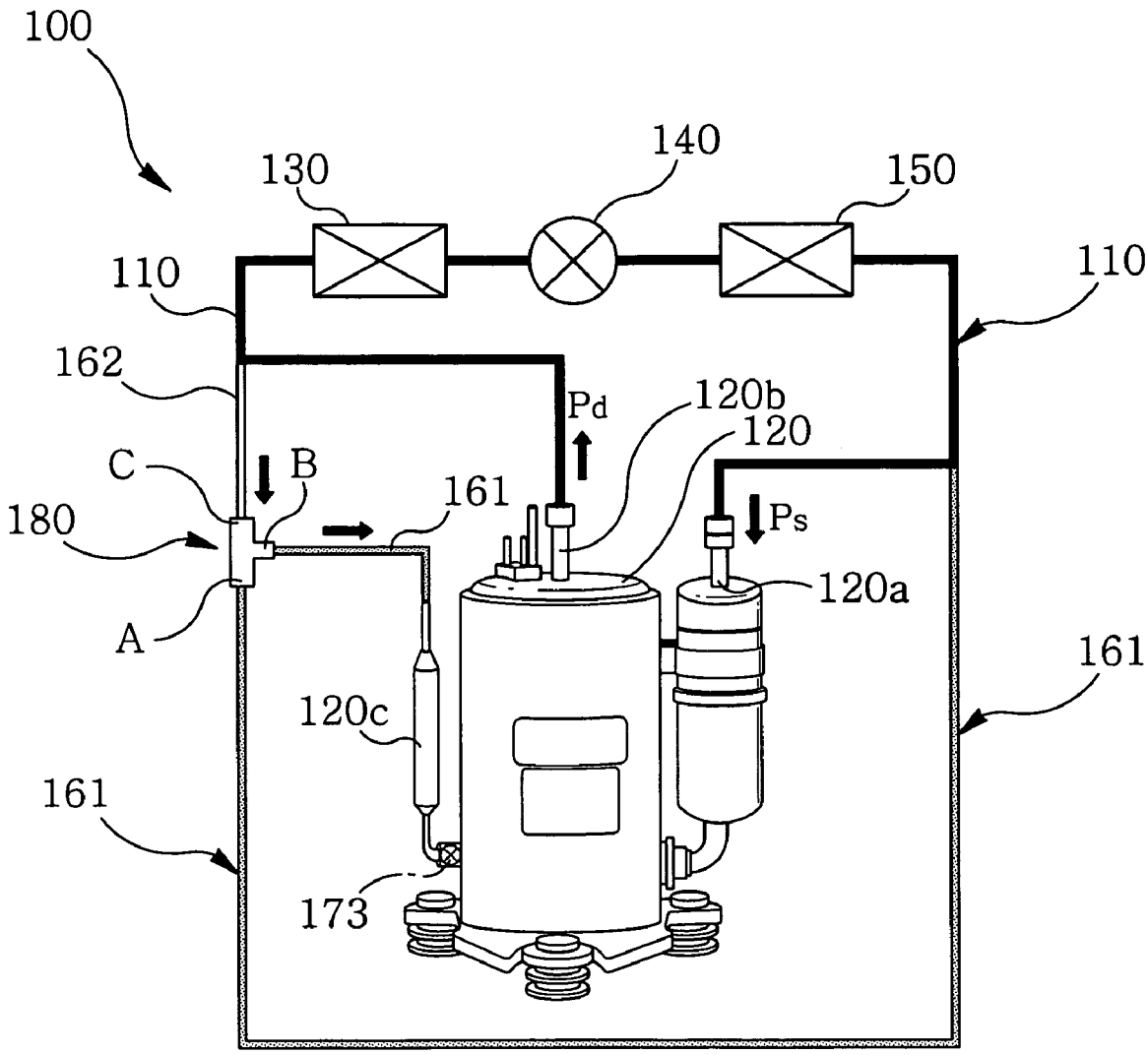
FIGS. 5*a* and 5*b* are schematic diagrams explaining a principal construction of a capacity-variable air conditioner and refrigerant flow state under each operation mode according to a second embodiment of the present invention.
Figure 5B:
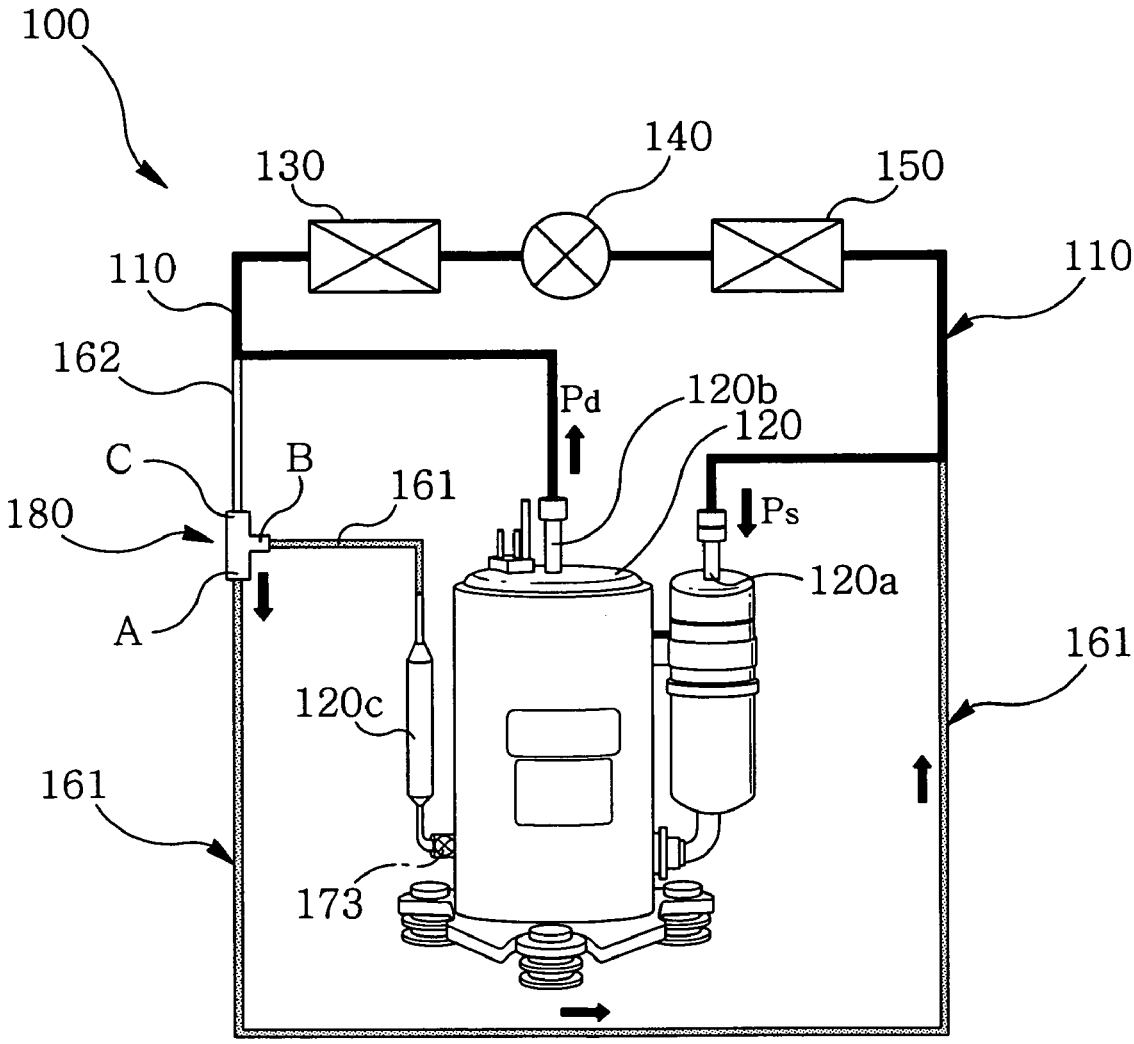

FIGS. 5*a* and 5*b* are schematic diagrams explaining a principal construction of a capacity-variable air conditioner and refrigerant flow state under each operation mode according to another embodiment of the present invention.

The construction according to the second embodiment of the present invention is the same as that of the first embodiment except that the second embodiment is disposed with a connector of the first bypass pipe (161) and the second bypass pipe (162) is mounted with a 3-way valve (180).

Referring to FIG. 5*a,* a passage "A" of the 3-way valve (180) is shut off by a control signal of a microcomputer (not shown) while passages "B" and "C" are opened under a normal operation mode of the capacity-variable air conditioner according to the second embodiment of the present invention.

As a result, the bypass valve (173) of the compressor (120) maintains closeness by pressure applied to the bypass valve (173) disposed at the bypass pipe connector (120*c*) of the compressor (120) from the refrigerant of high pressure discharged from the refrigerant outlet (120*b*) of the compressor (120) through the control of the 3-way valve (180).

Under this circumstance, because the bypass valve (173) maintains the closeness of the bypass valve (173), the refrigerant infused via the refrigerant inlet (120*a*) of the compressor (120) is compressed in a state of being kept in the compression region (P) as in the normal operation mode of the conventional air conditioner to circulate in the refrigerant cooling cycle.

Referring to FIG. 5*b,* the "C" passage of the 3-way valve (180) is closed in response to a control signal of a microcomputer (not shown) when the capacity variable air conditioner according to the present embodiment of the invention is run under the energy saving operation mode and at the same time the "A" and "B" passages are opened.

Accordingly, the first bypass pipe (161) maintains a relatively lower pressure state through the control of the 3-way valve (180) compared with the interior of the compressor (120) such that the bypass valve (173) disposed at the bypass pipe connector (120*c*) of the compressor (120) keeps the openness. Under this circumstance, the compressor (120) is operated in such a manner that, because the bypass valve (173) maintains the openness, some of the refrigerant compressed and infused via the refrigerant inlet (120*a*) of the compressor (120) is discharged to the first bypass pipe (161) via the bypass valve (173), passes the "B" and "A" passages of the 3-way valve (180) and is infused again into the refrigerant inlet (120*a*). As a result, the refrigerant reduced in pressure and compressed in the compressor (120) is further compressed in the compression region (P) and discharged to the condenser (130) such that the circulation quantity of the refrigerant is reduced under the energy saving operation mode where the load of the compressor is less than that of the normal operation mode, thereby enabling to reduce the capacity and the electric consumption.

According to another aspect of the present invention, it should be apparent that the 3-way valve (180) can be replaced by a 4-way valve. If a 3-way valve is replaced by a 4-way valve, a passage of any one side of the 4-way valve should maintain closeness at all times.

As apparent from the foregoing, there are advantages as given below in the capacity-variable air conditioner thus described according to the present invention.

First, addition of a bypass pipe and a open/close valve alone can economically constitute a capacity-variable air conditioner to thereby enable to reduce the manufacturing cost of component parts of an air conditioner.

Second, capacity and consumed electricity can be controlled by operation control of open/close valves of a bypass pipe controlling the compressed quantity of refrigerant of a compressor to thereby enable to improve reliability and performance of the parts of the air conditioner.

Third, comfortable operation of the parts of the air conditioner can be enhanced by switch of operation modes via operation control of open/closeness valves.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A variable capacity air conditioner comprises: a compressor provided with a bypass pipe connector connected with a refrigerant inlet, a refrigerant outlet and a bypass valve; a condenser configured to condense refrigerant infused by being discharged from the compressor; an expansion device configured to reduce pressure of the refrigerant condensed by the condenser to an evaporable state; an evaporator configured to evaporate the refrigerant expanded by the expansion device by heat exchange with ambient air; a refrigerant circulation pipe connected to the refrigerant inlet and the refrigerant outlet and configured to form a refrigerant circulation route by being connected to the condenser, the expansion device and the evaporator; a bypass pipe mounted so as to connect the bypass pipe connector of the compressor to connect to the refrigerant circulation pipe; and at least one open/close valve configured to selectively open and close the bypass pipe so that refrigerant compression quantity of the compressor can be adjusted in response to an operation mode, wherein the bypass pipe comprises a first bypass pipe with one end connected to a refrigerant circulation pipe at the refrigerant inlet side of the compressor and an other end contiguously connected to the bypass pipe connector of the compressor; and a second bypass pipe for connecting the refrigerant circulation pipe of the refrigerant outlet side of the compressor to the first bypass pipe.

2. The air conditioner as defined in claim 1, wherein a connector between the first bypass pipe and the second bypass pipe is disposed with the at least one open/close valve.

3. The air conditioner as defined in claim 2, wherein the at least one open/close valve is either a 3-way valve or a 4-way valve.

4. The air conditioner as defined in claim 1, wherein the first bypass pipe and the second bypass pipe are respectively disposed with a first open/close valve and a second open/close valve.

5. The air conditioner as defined in claim 4, wherein the first open/close valve and the second open/close valve are so controlled as to conduct mutually opposed open/close operations in response to an operation mode.

6. The air conditioner as defined in claim 4, wherein the refrigerant compression quantity of the compressor is controllably adjusted by an amount of openness of the bypass valve in response to changes of the refrigerant pressure that occur by a control where the first open/close valve is opened and the second open/close valve is concurrently closed during the energy-saving mode operation.

7. The air conditioner as defined in claim 1, wherein the bypass valve is open and closed by pressure changes of the refrigerant in response to an amount of openness of the bypass pipe.

8. The air conditioner as defined in claim 1, wherein the bypass valve is closed under a normal operation mode and is open under an energy saving operation mode.

* * * * *